US010663166B1

(12) United States Patent
Hancock

(10) Patent No.: US 10,663,166 B1
(45) Date of Patent: May 26, 2020

(54) DEVICE AND METHOD FOR STARTING A FIRE

(71) Applicant: Larry G. Hancock, Townsend, MT (US)

(72) Inventor: Larry G. Hancock, Townsend, MT (US)

( * ) Notice: Subject to any disclaimer, the term of this patent is extended or adjusted under 35 U.S.C. 154(b) by 0 days.

(21) Appl. No.: 16/660,320

(22) Filed: Oct. 22, 2019

(51) Int. Cl.
*F23Q 2/18* (2006.01)
*C10L 11/04* (2006.01)
*F23Q 2/44* (2006.01)

(52) U.S. Cl.
CPC ..... *F23Q 2/18* (2013.01); *F23Q 2/44* (2013.01); *C10L 11/04* (2013.01)

(58) Field of Classification Search
CPC ..... F23Q 2/18; F23Q 2/44; C10L 11/04
See application file for complete search history.

(56) References Cited

U.S. PATENT DOCUMENTS 435,508 A * 9/1890 Walters ..... B61K 1/02 258/22
436,509 A * 9/1890 Walters ..... C10L 11/04 44/506
443,986 A * 12/1890 Fredrikson ..... F23Q 2/24 431/272
612,293 A * 10/1898 Wolf ..... F23Q 2/24 431/272
618,997 A * 2/1899 Rose ..... A24D 1/08 44/508
1,275,543 A * 8/1918 Naldrett ..... A24D 1/08 44/508
2,622,017 A 12/1952 Bramhall et al.
3,297,420 A 1/1967 Klink et al.
3,367,757 A 2/1968 Church
3,374,071 A 3/1968 Corriher et al.
(Continued)

FOREIGN PATENT DOCUMENTS

DE 202014007858 U1 * 10/2014 ..... C10L 11/04
DE 202015008606 U1 * 2/2016 ..... A47J 37/079

OTHER PUBLICATIONS

Aug. 2, 2018 by Procamptek of a Fire Strip Roll dhttps://www.youtube.com/watch?v=ut_dRWuRvjc (Year: 2018).*
(Continued)

*Primary Examiner* — Pamela H Weiss
(74) *Attorney, Agent, or Firm* — MacBride Law, PLLC; William L. MacBride, Jr.

(57) ABSTRACT

A fire kindling device and method having a wick and a coated fuel material strip. A user loosely rolls the coated fuel material strip into a spiraled cylindrical coil defining and creating a gap between radially spaced sections. The user places the spiraled cylindrical coil in an upright position, presses the wick into a centrally located apex point over the radius of the spiraled cylindrical coil and down the exterior side wall and then stacks combustible kindling material around the spiraled cylindrical coil. The wick is ignited, igniting the fire fuel causing the fire fuel to ignite the coated fuel material strip within the spiraled cylindrical coil, thereby causing a kindling fire. The sections are ignited nearly simultaneously, igniting the combustible kindling material. The fire fuel transforms into a combustible gas within the gap, augmenting combustion of the fire fuel, and increasing the temperature of the kindling fire.

23 Claims, 5 Drawing Sheets

(56) References Cited

U.S. PATENT DOCUMENTS

| | | | | |
|---|---|---|---|---|
| 3,759,675 | A | 9/1973 | Lazarus et al. | |
| 6,136,053 | A * | 10/2000 | Sullivan | C10L 11/04 44/506 |
| 8,216,322 | B2 | 7/2012 | Schweickhardt | |
| 8,657,891 | B2 | 2/2014 | Heumuller | |
| 2003/0084605 | A1* | 5/2003 | Mertz | C10L 11/06 44/519 |
| 2006/0117649 | A1* | 6/2006 | Schweickhardt | C10L 5/36 44/535 |
| 2011/0274859 | A1* | 11/2011 | Hauser | B32B 1/08 428/34.2 |
| 2012/0328995 | A1* | 12/2012 | Fandrich | C10L 11/06 431/6 |

OTHER PUBLICATIONS

"Homemade Firestarters for Backyard BBQ's" (2014) (referred to as "Homemade") https://www.youtube.com/watch?v=FcZ1m9L3GP0 (Year: 2014).*

Barbara Norton Demonstration How to Make a Toilet Paper Wick https://www.youtube.com/watch?v=6lzmBwS2n10 (Year: 2014).*

By Procamptek of a Fire Strip Roll made from fibrous paper infused with wax rolled/coiled https://www.youtube.com/watch?v=ut_dRWuRvjc https://www.procamptek.com/products/fire-strip-roll (Year: 2018).*

* cited by examiner

DEVICE AND METHOD FOR STARTING A FIRE

FIELD OF THE INVENTION

This application relates to a device and method for starting a fire, and particularly a device and method for starting a fire that reduces the need for kindling, as a paraffin cloth-based fire starter.

BACKGROUND OF THE INVENTION

Fire staring devices are historically well known. Inefficient fire starters need large amounts of kindling sufficient to start a fire. There has been a recognized need for long-burning fire starters that create more intense heat, thus lessening the need for kindling.

As well, there has been a recognized need for easily starting a fire with minimal kindling.

There are various fire starting devices and methods for lighting fires described in the related art, but none of those inventions disclose all the features of the present invention and would not be as suitable for the required purpose as set for the manner of the present invention hereinafter described, such as U.S. Pat. No. 8,216,322 to Schweickhardt ("Schweickhardt") and U.S. Pat. No. 8,657,891 to Heumuller ("Heumuller"). No single reference discloses all features of the present invention. Although Schweickhardt and Heumuller disclose spiral wound fire starters having paraffin wax fuels, neither device is adapted to be unwound or is provided with a wick. Schweickhardt discloses a wicking element; however, the wicking element in Schweickhardt is not a length of wick as normally understood in the industry but rather an uncoated end portion of the cylinder.

The present invention is not an obvious modification of an earlier invention. Nothing in Schweickhardt or Heumuller suggest it would be obvious to one of ordinary skill to unwind the cylinder and increase surface area, as disclosed in the present invention. Schweickhardt has a rigid housing preferably made from non-combustible material to retain the shape of that device during use. Heumuller discloses a paraffin soaked, wood fiber sheet wound into a spiral and adhesively connects the layers of the rolled cylinder. None of the related art references render the present invention obvious.

The U.S. Pat. No. 2,622,017 to Bramhall et al. ("Bramhall") discloses a fire starting container with wax layers and color producing salt layers with wick. Although Bramhall discloses a wick, the wick element lies transverse to the diameter of that device and extends only into a top layer. Bramhall differs from the present invention where the wick in the present invention is disclosed to extend across the entire diameter of the cylinder and is in contact with each layer. The present invention discloses a length of wick that is oriented along the diameter of one end of the cylinder to ignite each layer within the cylinder. This feature is also not disclosed nor suggested by the prior art.

None of the references in the related art contain every feature of the present invention, and none of these references in combination disclose, suggest or teach every feature of the present invention. The present invention is neither anticipated by nor rendered obvious over the related art.

The foregoing and other objectives, advantages, aspects, and features of the present invention will be more fully understood and appreciated by those skilled in the art upon consideration of the detailed description of a preferred embodiment, presented below in conjunction with the accompanying drawings.

SUMMARY OF THE INVENTION

The present invention is a fire kindling device comprising a coated fuel material strip rolled into a spiraled cylindrical coil thereby defining a plurality of sections radially spaced within the spiraled cylindrical coil. The coated fuel material is a cloth, or other combustible material, coated with a fire fuel of paraffin wax or beeswax.

In one embodiment of the present invention the spiraled cylindrical coil is in an upright position and has an exterior side wall, a top portion, a radius, and a centrally located apex point within the top portion. Also provided is a wick having a secured wick end and an opposing free wick end. A user wraps the coated fuel material strip loosely into the spiraled cylindrical coil, expanding the radius laterally with the wick extending across the radius. In alternative embodiments there may be multiple wicks available for multiple ignitions.

The kindling fire device is unwound for use and rewound with the secured wick end, either located at the centrally located apex point, at a central coil end, or located at the opposing free coil end. The spiraled cylindrical coil in alternative embodiments of the present invention has the secured wick end being securedly fastened and pressed into the spiraled cylindrical coil at the centrally located apex point at the central coil end. Between the plurality of sections in the spiraled cylindrical coil, a gap is created when the fire kindling device is rewound. The opposing free wick end extends from the centrally located apex point generally over the radius of the spiraled cylindrical coil, downward and along the exterior side wall of the spiraled cylindrical coil. Combustible kindling material is stacked by the user around and proximal to the spiraled cylindrical coil. The combustible kindling material is at least one of combustible wood, coal, charcoal or other solid fuel material. In different embodiments of the present invention, an igniting means is necessary for igniting the wick, comprising one of a match, an igniter, lighter or other fire lighting implement. The user ignites the wick at the opposing free wick end using the igniting means, causing the fire fuel to ignite along the radius on the top portion of the plurality of sections, which ignite essentially simultaneously and burn continuously. The fire kindling device ignites the combustible kindling material and starts a kindling fire.

In another embodiment of the present invention, the spiraled cylindrical coil has a diameter, and the user wraps the coated fuel material strip loosely into the spiraled cylindrical coil, the diameter thereby expanding laterally and the wick extending across the diameter. The secured wick end is securedly fastened and pressed into the top portion at the opposing free coil end. The opposing free wick end extends generally over the diameter of the spiraled cylindrical coil, across the top portion, and downward and along the exterior side wall of the spiraled cylindrical coil.

An alternative embodiment of the present invention is a method for starting a kindling fire, having a coated fuel material strip which comprises a plurality of surface areas using a cloth as the coated fuel material strip. The plurality of surface areas are coated with a fire fuel. A user loosely rolls the coated fuel material strip into a spiraled cylindrical coil defining a plurality of sections radially spaced within the spiraled cylindrical coil, and creating a gap between the plurality of sections. The spiraled cylindrical coil has an exterior side wall, a radius, at least one wick having a secured wick end and an opposing free wick end. The user places the spiraled cylindrical coil in an upright position, presses and securedly fastens the secured wick end into the spiraled cylindrical coil within a center position of the spiraled cylindrical coil, and extends the opposing free wick end generally from the centrally located apex point over the radius of the spiraled cylindrical coil and generally vertically downward and substantially and conveniently down the exterior side wall of the spiraled cylindrical coil, and stacks combustible kindling material around the spiraled cylindrical coil and ignites the wick at the opposing free end using an igniting means. The wick ignites the fire fuel whereby (or causing) the fire fuel ignites the coated fuel material strip within the spiraled cylindrical coil and thereby causing a kindling fire, igniting the combustible kindling material.

The fire fuel is transformed into a combustible gas within the gap, thereby augmenting combustion of the fire fuel, increasing the temperature of the kindling fire. The exposed plurality of sections are also ignited nearly simultaneously, and ignite the combustible kindling material surrounding the spiraled cylindrical coil.

The fire kindling device is compact, unrolls to create a surface area of a coated fuel material strip larger than found in conventional fire starters. The fire kindling device extends the combustion duration and intensity of flame when ignited, and lessens the amount of fire fuel needed to start and maintain the kindling fire.

In one alternative embodiment of the present invention, the coated fuel material strip comprises a paraffin coated cloth strip rolled in the spiraled cylindrical coil.

The fire starting device allows for easily starting a fire with a minimal amount of the fire fuel, or kindling, for use with a camp fire, woodstove or fireplace. The gap in the spiraled cylindrical shape traps the fire fuel when transformed into a combustible gas as the fire fuel heats, increasing the burn efficiency of the coated fuel material strip.

The present invention provides an improvement over present fire starting devices by providing a larger surface area for initial combustion and by trapping combustible gases within the cylinder for enhancing heat intensity.

The aforementioned features, objectives, aspects and advantages of the present invention, and further objectives and advantages of the invention, will become apparent from a consideration of the drawings and ensuing description.

BRIEF DESCRIPTION OF THE SEVERAL VIEWS OF THE DRAWINGS

The foregoing features and other aspects of the present invention are explained and other features and objects of the present invention will become apparent in the following detailed descriptions, taken in conjunction with the accompanying drawings. However, the drawings are provided for purposes of illustration only, and are not intended as a definition of the limits of the invention.

DETAILED DESCRIPTION OF THE INVENTION

Figure 1:
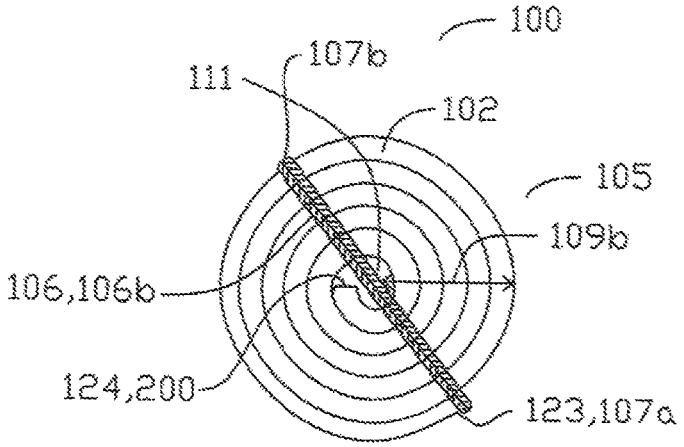
FIG. 1. illustrates a top planar view of one embodiment of the present invention, depicting a fire kindling device having a wick along the diameter of a top portion of a spiraled cylindrical coil, attaching to a central coil end at its secured wick end.

The present invention will now be described more fully hereinafter with references to the accompanying drawings, in which the preferred embodiment of the invention is shown. This invention, however, may be embodied in different forms, and should not be construed as limited to the embodiments set forth herein. Rather, the illustrative embodiments are provided so that this disclosure will be thorough and complete, and will fully convey the scope of the invention to those skilled in the art. It should be noted, and will be appreciated, that numerous variations may be made within the scope of this invention without departing from the principle of this invention and without sacrificing its chief advantages. Like numbers refer to like elements throughout.

Turning now in detail to the drawings in accordance with the present invention, one embodiment of the present invention is shown in FIGS. 1-11 as a fire kindling device 100 comprising a coated fuel material strip 102 made of a first side surface area 103*a* and an opposing second side surface area 103*b* (depicted in FIG. 3), and a central coil end 123 and an opposing free coil end 124. The coated fuel material strip 102 is rolled into a spiraled cylindrical coil 105 thereby defining a plurality of sections 117 (shown in FIG. 10) radially spaced within the spiraled cylindrical coil 105. The coated fuel material strip 102 is a cloth 108, or other combustible material, coated with a fire fuel 101, as indicated generally in FIG. 3 but not visually.

Figure 3:
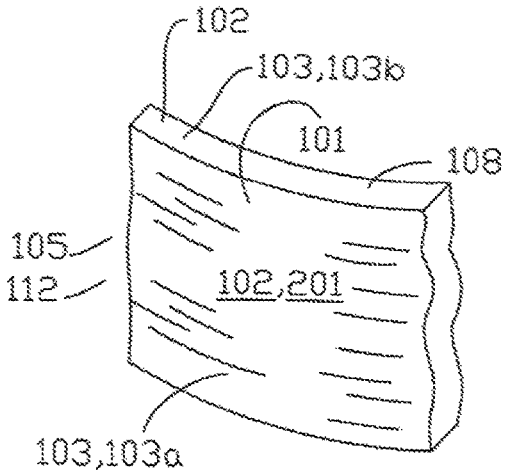
FIG. 3 illustrates a partial, prospective view of a portion of a coated fuel material strip from the spiraled cylindrical coil of one embodiment of the present invention.

The cloth 108, or cloth material, in alternative embodiments of the present invention may have organic fibers as well as, in alternative embodiments, paraffin coated cloth strips 201 as generally indicated in FIG. 3.

In alternative embodiments of the present invention, shown in FIGS. 1-11, the fire fuel 101 is one of paraffin wax or beeswax. Other fire fuels known in the industry may be used.

In one embodiment of the present invention; shown in FIGS. 2, 5, 7, and 9-11; the spiraled cylindrical coil 105 is in an upright position 112 and has an exterior side wall 110, a top portion 116, a radius 109*b*, and a centrally located apex point 111 within the top portion 116 at the central coil end 123. Also provided is a wick 106 having a secured wick end 107*a* and an opposing free wick end 107*b*. A user 120 wraps or winds, or rewinds, the coated fuel material strip 102 loosely into the spiraled cylindrical coil 105, thereby expanding the radius 109*b* laterally, with the wick 106 extending across the radius 109*b*.

Figure 2:
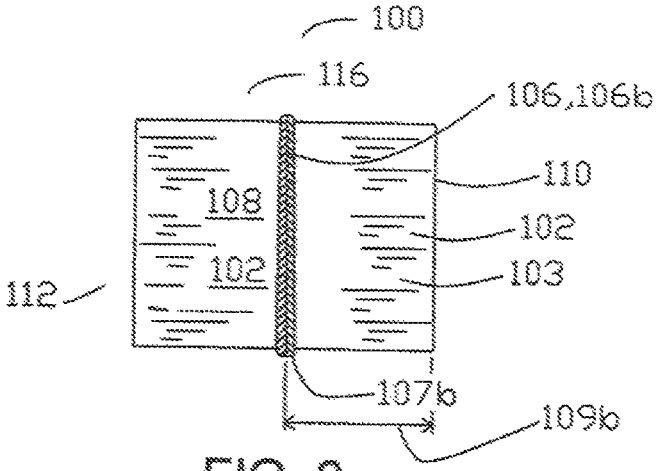
FIG. 2 illustrates an elevational view of one embodiment of the present invention, depicting at least one wick extending substantially downward on an exterior side wall of the fire kindling device and depicting the radius of the spiraled cylindrical coil.
Figure 4:
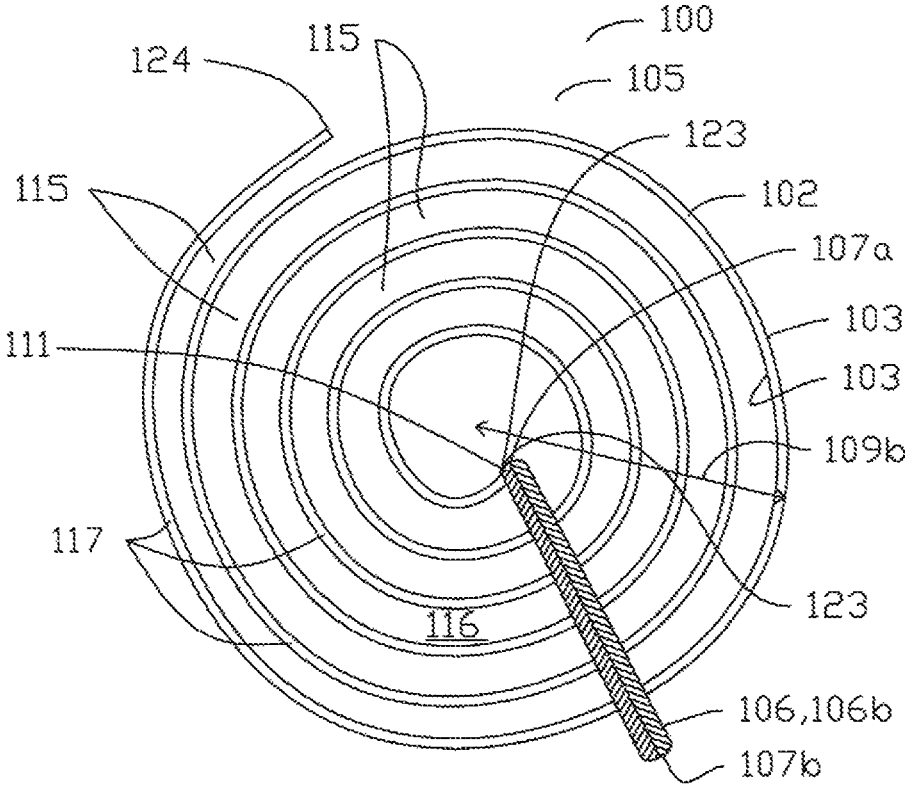
FIG. 4 illustrates a top planar view of one embodiment of the present invention, depicting the spiraled cylindrical coil which is loosely wound or loosely rewound with at least one wick extending radially.
Figure 5:
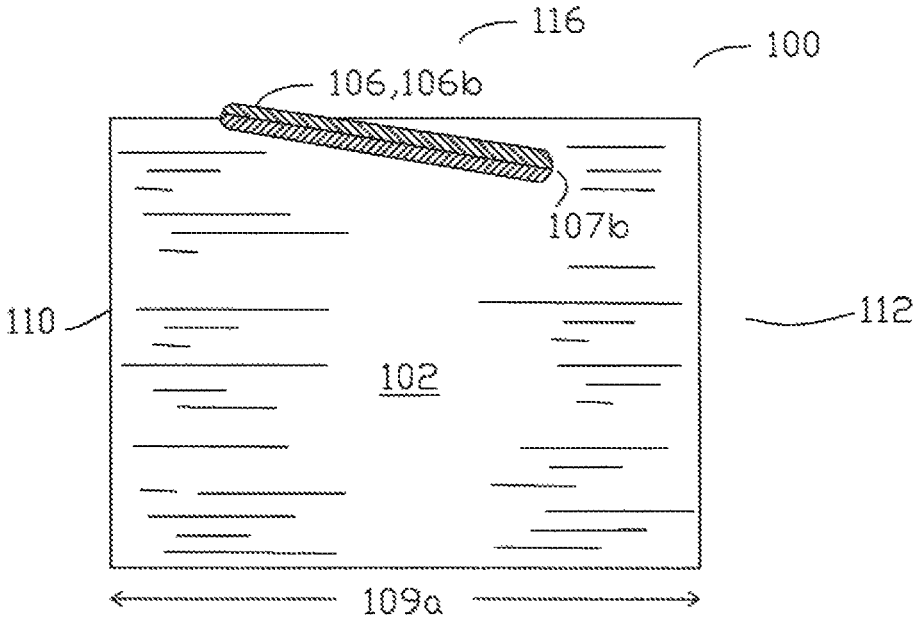
FIG. 5 illustrates an elevational view of one embodiment of the present invention, depicting a wick extending partially and angularly downward on an exterior side wall of the fire kindling device.
Figure 6:
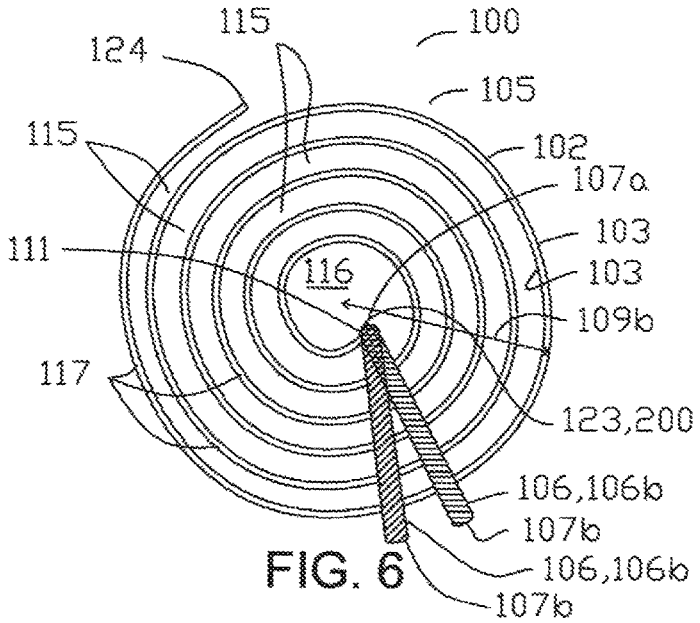
FIG. 6 illustrates a top planar view of one embodiment of the present invention, depicting the spiraled cylindrical coil which is loosely wound or loosely rewound and at least one wick extending along a radius at a top portion of a spiraled cylindrical coil.
Figure 7:
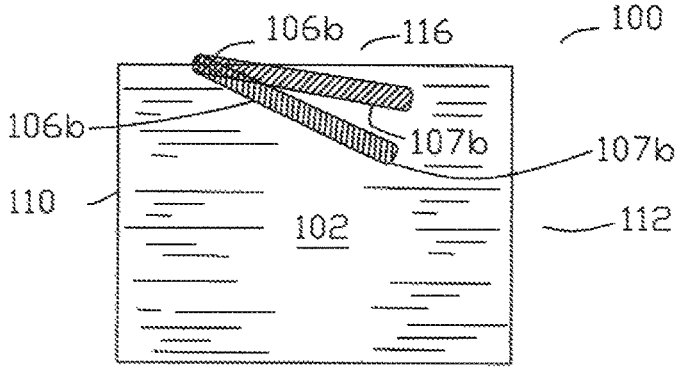
FIG. 7 illustrates an elevational view of one embodiment of the present invention, depicting at least one wick extending partially and angularly downward on an exterior side wall of the fire kindling device.

The wick 106 in alternative embodiments in the present invention comprises at least one wick 106*b*, so that there may be multiple wicks available for multiple ignitions, as shown in FIGS. 1, 2, and 4-11 which a user 120 may unwind from the kindling fire device 100 when purchased, and wind as a wick 106 as shown in FIGS. 1 and 2, and unwind or rewind as at least one wick 106*b* in FIGS. 6 and 7. The kindling fire device 100 is unwound for use and rewound with the secured wick end 107*a*, either located at the centrally located apex point 111, at the central coil end 123, as shown in FIGS. 1, 4 and 6, or located at the opposing free coil end 124, shown in FIG. 8.

The wick 106 in alternative embodiments of the present invention is one of cotton string 118 (depicted generally in FIGS. 1, 8, and 11) or roping (or rope), twine, cloth, hemp, other natural fiber or non-woven fibrous material.

The spiraled cylindrical coil 105; shown in FIGS. 4, 6, 8, 10, and 11 in alternative embodiments of the present invention; has the secured wick end 107*a* being securedly fastened and pressed into the spiraled cylindrical coil 105 at the centrally located apex point 111 at the central coil end 123. Between the plurality of sections 117 in the spiraled cylindrical coil 105, a gap 115 is created when the fire kindling device 100 is unwound and rewound. The opposing free wick end 107*b* extends away from the centrally located apex point 111 generally over the radius 109*b* of the spiraled cylindrical coil 105, across the top portion 116, downward and along the exterior side wall 110 of the spiraled cylindrical coil 105.

Figure 10:
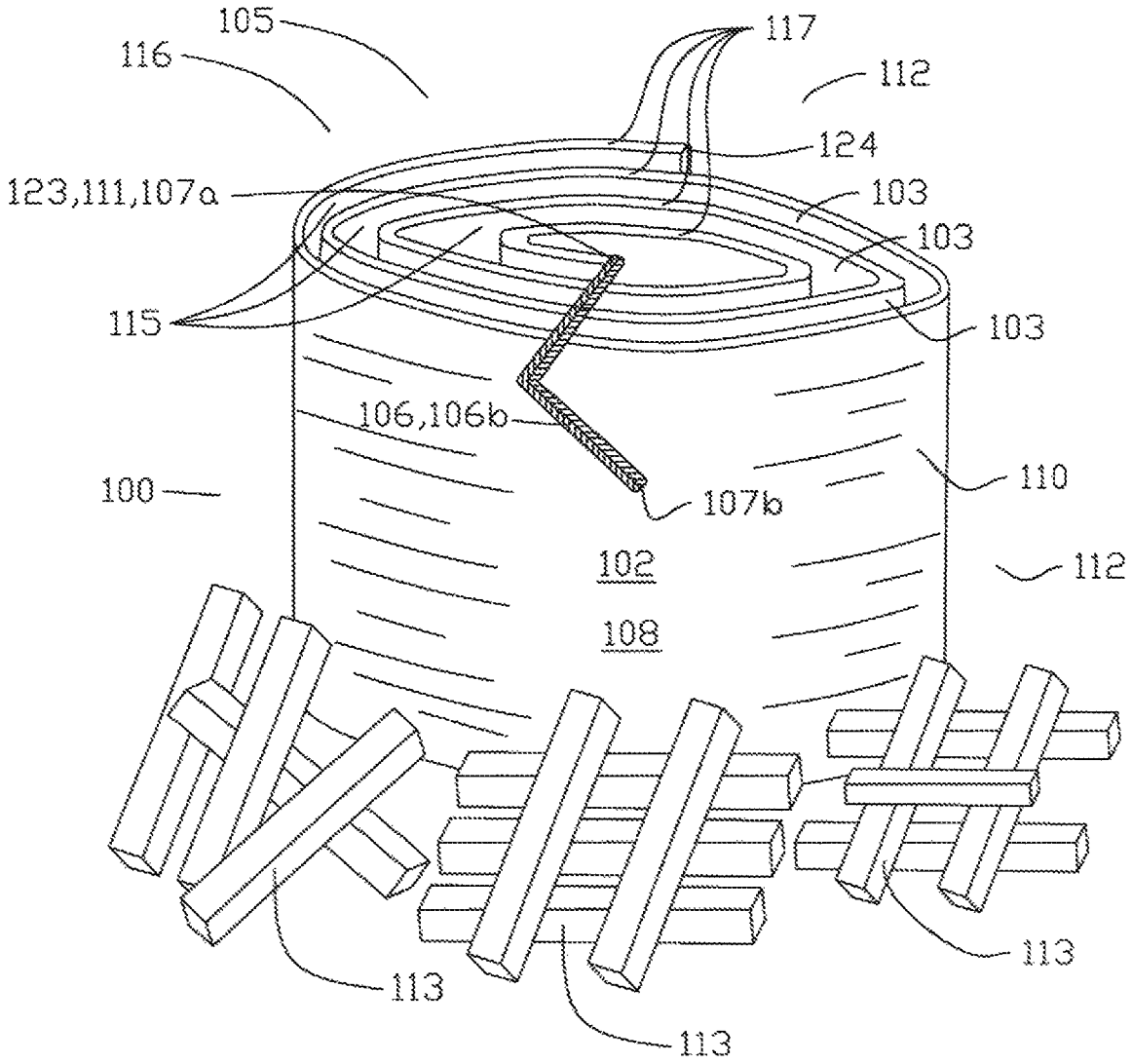
FIG. 10 illustrates a perspective view of one embodiment of the present invention, depicting a fire kindling device within combustible kindling material.
Figure 11:
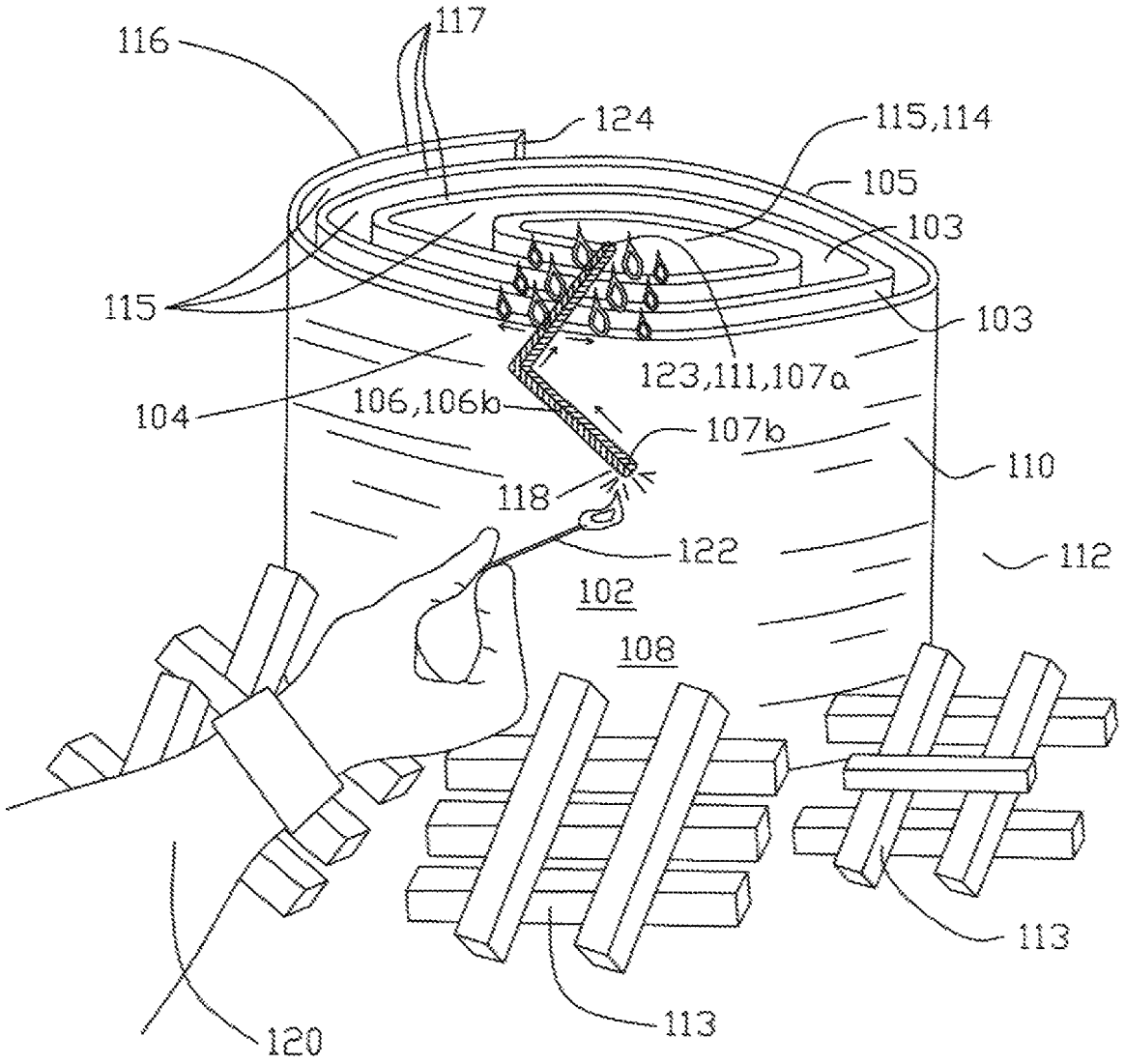
FIG. 11 illustrates a perspective view of one embodiment of the present invention, depicting a fire kindling device having the wick ignited by a user.

In one embodiment of the present invention, combustible kindling material 113 is stacked by the user 120 around and proximal to the spiraled cylindrical coil 105, as shown in FIGS. 10 and 11. The combustible kindling material 113 is at least one of combustible wood, as depicted in FIGS. 10 and 11, coal, charcoal or other solid fuel material.

In different embodiments of the present invention, an igniting means 122 is necessary for igniting the wick 106. The igniting means comprises one of a match, as shown in FIG. 11, or an igniter, lighter or other fire lighting implement. The user 120 ignites the wick 106 at the opposing free wick end 107*b* using the igniting means 122, causing the fire fuel 101 to ignite along the radius 109*b* on the top portion 116 of the plurality of sections 117, the plurality of sections 117 ignite, essentially simultaneously and burn continuously. The fire kindling device 100 ignites the combustible kindling material 113 and starts a kindling fire 104.

Figure 8:
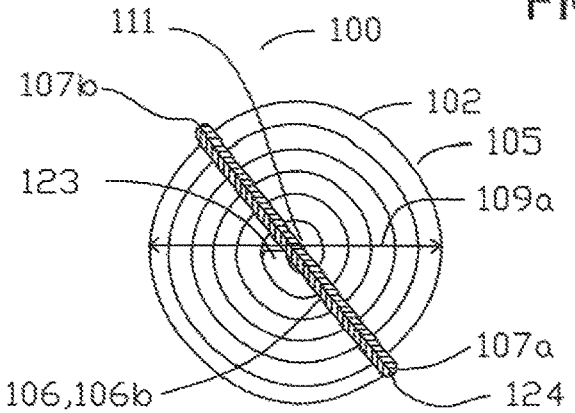
FIG. 8 illustrates a top planar view of one embodiment of the present invention, depicting a fire kindling device having an at least one wick along the diameter of a top portion of a spiraled cylindrical coil, attaching to an opposing free coil end at its secured wick end.
Figure 9:
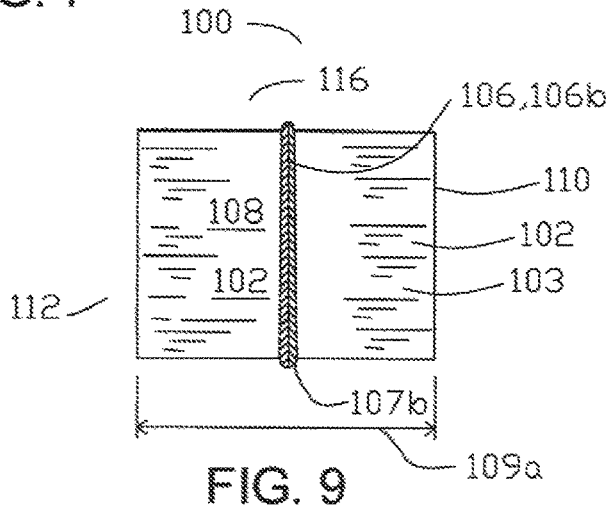
FIG. 9 illustrates an elevational view of one embodiment of the present invention, depicting at least one wick extending substantially downward on an exterior side wall of the fire kindling device and depicting the diameter of the spiraled cylindrical coil.

In another embodiment of the present invention, shown in FIGS. 8 and 9, the fire kindling device 100 again comprises a coated fuel material strip 102 made of a first side surface area 103*a* and an opposing second side surface area 103*b* (depicted in FIG. 3), and a central coil end 123 and an opposing free coil end 124, and the coated fuel material strip 102 is rolled into a spiraled cylindrical coil 105 thereby defining a plurality of sections 117 (shown in FIG. 10) radially spaced within the spiraled cylindrical coil 105. The coated fuel material strip 102 is a cloth 108, or other combustible material, coated with a fire fuel 101, as indicated generally in FIG. 3 but not visually. The spiraled cylindrical coil 105 is in an upright position 112 and has an exterior side wall 110, a top portion 116, a diameter 109*a*, and a centrally located apex point 111 within the top portion 116 at the central coil end 123. The wick 106 has a secured wick end 107*a* and an opposing free wick end 107*b*. A user 120 wraps the coated fuel material strip 102 loosely into the spiraled cylindrical coil 105, the diameter 109*a* thereby expanding laterally and the wick 106 extending across the diameter 109*a*.

With the spiraled cylindrical coil 105 in this alternative embodiment of the present invention; shown in FIGS. 8 and 9, the secured wick end 107*a* is securedly fastened and pressed into the top portion 116 at the opposing free coil end 124. Between the plurality of sections 117 (depicted in FIGS. 4, 7 and 10) in the spiraled cylindrical coil 105, a gap 115 is created when the fire kindling device 100 (as shown in FIGS. 4 and 7) is rewound. The opposing free wick end 107*b* extends generally over the diameter 109*a* of the spiraled cylindrical coil 105, across the top portion 116, and downward and along the exterior side wall 110 of the spiraled cylindrical coil 105.

In this alternative embodiment of the present invention, presented immediately above, combustible kindling material 113 is stacked by the user 120 around and proximal to the spiraled cylindrical coil 105, as shown in FIGS. 10 and 11. The combustible kindling material 113 is at least one of combustible wood, as depicted in FIGS. 10 and 11, coal, charcoal or other solid fuel material. An igniting means 122 is necessary for igniting the wick 106. The igniting means comprises one of a match, as shown in FIG. 11, or an igniter, lighter or other fire lighting implement. The user 120 ignites the wick 106 at the opposing free wick end 107*b* using the igniting means 122, causing the fire fuel 101 on the coated fuel material strip 102 to ignite along the diameter 109*a* on the top portion 116 of the plurality of sections 117, whereby the plurality of sections 117 ignite, essentially simultaneously and burn continuously. The fire kindling device 100 ignites the combustible kindling material 113 and starts a kindling fire 104.

An alternative embodiment of the present invention is a method for starting a kindling fire 104, shown in FIG. 11, having a coated fuel material strip 102 which comprises a plurality of surface areas 103, and using a cloth 108 as the coated fuel material strip 102 (depicted in FIG. 3), while coating the plurality of surface areas 103 with a fire fuel 101. A user 120 loosely rolls the coated fuel material strip 102 into a spiraled cylindrical coil 105 thereby defining a plurality of sections 117 radially spaced within the spiraled cylindrical coil 105, creating a gap 115 between the plurality of sections 117, as shown in FIGS. 4, 6, and 11. The spiraled cylindrical coil 105 has an exterior side wall 110, and a radius 109*b*, as shown in FIG. 2.

This method, an alternative embodiment of the present invention; as shown in FIGS. 1, 4, 6, and 11; provides at least one wick 106*b* having a secured wick end 107*a* and an opposing free wick end 107*b*. The user 120 places the spiraled cylindrical coil 105 in an upright position 112, presses and securedly fastens the secured wick end 107*a* into the spiraled cylindrical coil 105 within a center position 200 of the spiraled cylindrical coil 105 (shown in FIG. 1), and extends the opposing free wick end 107*b* generally from the centrally located apex point 111 and center position 200 over the radius 109*b* of the spiraled cylindrical coil 105 and generally vertically downward and substantially and conveniently down the exterior side wall 110 of the spiraled cylindrical coil 105. The user 120 stacks combustible kindling material 113 around and proximal to the spiraled cylindrical coil 105 and ignites the wick 106 at the opposing free end 107*b* using an igniting means 122, the wick 106 igniting the fire fuel 101 causing the fire fuel 101 to ignite the coated fuel material strip 102 within the spiraled cylindrical coil 105 and thereby causing a kindling fire 104.

This method as an alternative embodiment of the present invention; shown in FIGS. 1, 4, 6, and 11; transforms the fire fuel 101 into a combustible gas 114 (generally depicted but invisible) within the gap 115, thereby augmenting combustion of the fire fuel 101, and increasing the temperature of the kindling fire 104. The exposed plurality of sections 117 adjacent to the gap 115 to the kindling fire 104 of the spiraled cylindrical coil 105 are also ignited nearly simultaneously, and ignite the combustible kindling material 113 surrounding the spiraled cylindrical coil 105. The fire fuel 101 is one of paraffin wax or beeswax, and the combustible kindling material 113 comprises at least one of combustible wood, coal, charcoal or other solid fuel material (as shown in FIGS. 10 and 11). The cloth in alternative embodiments may be made of organic fibers as well as paraffin coated cloth strips 201, shown in FIG. 3. The at least one wick 106*b* is made one of cotton string 118, roping, twine, cloth, hemp, other natural fiber or non-woven fibrous material. The igniting means 122 is one of a match, igniter, lighter or other fire lighting implement.

The present invention provides a fire starting device, the fire kindling device 100, or "fire starter", which is compact and which unrolls to create a surface area 103 of a coated fuel material strip 102 larger than found in conventional fire starters, thereby extending the combustion duration and intensity of flame, shown in FIG. 11, to the kindling fire 104 when ignited, and lessening the amount of fire fuel 101, such as additional kindling, needed to start and maintain the kindling fire 104.

In one alternative embodiment of the present invention, shown in FIG. 3, the coated fuel material strip 102 comprises a paraffin coated cloth strip 201. The paraffin coated cloth strip 201 is rolled in the spiraled cylindrical coil 105. The wick 106 is pressed into the paraffin coated cloth strip 201 at the secured wick end 107*a*.

The fire starting device 100 of the present invention allows for easily starting a fire with a minimal amount of the fire fuel 101, or kindling 204, for use with a camp fire, woodstove or fireplace. The fire starting device 100 assists in the efficient igniting of fires in campfires, in fireplaces and in wood burning stoves. As shown in FIGS. 10 and 11, the gap 115 in the spiraled cylindrical shape 105 traps the fire fuel 101 when transformed into a combustible gas 114 as the fire fuel 101 heats. This action increases burn efficiency of the coated fuel material strip 102. The wick 106 when ignited, in turn, ignites essentially simultaneously the plurality of sections 117 of the top portion 116 along the diameter 109. The spiraled cylindrical shape 105 provides for additional burning surface area, the plurality of surface areas 103 shown in FIGS. 4, 6, 10 and 11.

Having thus described in detail a preferred selection of embodiments of the present invention, it is to be appreciated, and will be apparent to those skilled in the art, that many physical changes could be made in the device without altering the invention, or the concepts and principles embodied therein.

Unless otherwise specifically stated, the terms and expressions have been used herein as terms of description and not terms of limitation, and are not intended to exclude any equivalents of features shown and described or portions thereof.

Various changes can, of course, be made to the preferred embodiment without departing from the spirit and scope of the present invention. The present invention device and method, therefore, should not be restricted, except in the following claims and their equivalents.

Although specific advantages have been enumerated above, various embodiments may include some, none, or all of the enumerated advantages.

Other technical advantages may become readily apparent to one of ordinary skill in the art after review of the following figures and description.

It should be understood at the outset that, although exemplary embodiments are illustrated in the figures and described herein, the principles of the present disclosure may be implemented using any number of techniques, whether currently known or not. The present disclosure should in no way be limited to the exemplary implementations and techniques illustrated in the drawings and described herein.

Unless otherwise specifically noted, articles depicted in the drawings are not necessarily drawn to scale.

Modifications, additions, or omissions may be made to the devices, systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

I claim:

1. A fire kindling device, said fire kindling device consisting of:

a. a coated fuel material strip;

b. the coated fuel material strip comprising: a first side surface area and an opposing second side surface area, and a central coil end and an opposing free coil end, the coated fuel material strip being rolled into a spiraled cylindrical coil thereby defining a plurality of sections radially spaced having a gap between each section within the spiraled cylindrical coil;

c. the coated fuel material strip further comprising: cloth coated with a fire fuel;

d. the spiraled cylindrical coil being in an upright position and comprising: an exterior side wall, a top portion, a radius, and a centrally located apex point within the top portion at the central coil end;

e. a wick having a secured wick end and an opposing free wick end;

f. the spiraled cylindrical coil providing the secured wick end being securedly fastened and pressed into the spiraled cylindrical coil at the centrally located apex point at the central coil end;
g. the wick extending across the radius of the spiraled cylindrical coil;
h. herein there is a gap between each section of the plurality of sections in the spiraled cylindrical coil;
i. the opposing free wick end extending from the centrally located apex point generally over the radius of the spiraled cylindrical coil, across the top portion, downward and along the exterior side wall of the spiraled cylindrical coil;
j. combustible kindling material being stacked around and proximal to the spiraled cylindrical coil; and
k. an igniting means for igniting the wick.

2. The fire kindling device of claim 1, wherein the fire fuel comprising one of: paraffin wax or beeswax.

3. The fire kindling device of claim 1, wherein the combustible kindling material comprising at least one of: combustible wood, coal, charcoal or other solid fuel material.

4. The fire kindling device of claim 1, wherein the cloth comprising: organic fibers.

5. The fire kindling device of claim 1, wherein the cloth comprising: paraffin coated cloth strips.

6. The fire kindling device of claim 1, wherein the wick comprising at least one of: cotton string, roping, twine, cloth, hemp, other natural fiber or non-woven fibrous material.

7. The fire kindling device of claim 1, wherein the igniting means comprising at least one of: a match, igniter, lighter or other fire lighting implement.

8. The fire kindling device of claim 1, further comprising: an at least one wick.

9. A fire kindling device, said fire kindling device consisting of:
a. a coated fuel material strip;
b. the coated fuel material strip comprising: a first side surface area and an opposing second side surface area, and a central coil end and an opposing free coil end, the coated fuel material strip being rolled into a spiraled cylindrical coil thereby defining a plurality of sections radially spaced having a gap between each section within the spiraled cylindrical coil;
c. the coated fuel material strip further comprising: cloth coated with a fire fuel;
d. the spiraled cylindrical coil being in an upright position and comprising: an exterior side wall, a top portion, a diameter, and a centrally located apex point within the top portion at the central coil end;
e. a wick having a secured wick end and an opposing free wick end;
f. the spiraled cylindrical coil providing the secured wick end being securedly fastened and pressed into the spiraled cylindrical coil into the top portion at the opposing free coil end;
g. the wick extending across the diameter of the spiraled cylindrical coil;
h. wherein the is a gap between each section of the plurality of sections in the spiraled cylindrical coil;
i. the opposing free wick end generally extending over the diameter of the cylindrical coil, across the top portion, and downward and along the exterior side wall of the spiraled cylindrical coil;
j. combustible kindling material being stacked around and proximal to the spiraled cylindrical coil; and
k. an igniting means for igniting the wick.

10. The fire kindling device of claim 9, wherein the fire fuel comprising one of: paraffin wax or beeswax.

11. The fire kindling device of claim 9, wherein the combustible kindling material comprising at least one of: combustible wood, coal, charcoal or other solid fuel material.

12. The fire kindling device of claim 9, wherein the cloth comprising: organic fibers.

13. The fire kindling device of claim 9, wherein the cloth comprising: paraffin coated cloth strips.

14. The fire kindling device of claim 9, wherein the wick comprising at least one of: cotton string, roping, twine, cloth, hemp, other natural fiber or non-woven fibrous material.

15. The fire kindling device of claim 9, wherein the igniting means comprising at least one of: a match, igniter, lighter or other fire lighting implement.

16. The fire kindling device of claim 9 further comprising: an at least one wick.

17. A method for starting a kindling fire, said method consisting of:
a. having a coated fuel material strip comprising a plurality of surface areas;
b. wherein the coated fuel material strip comprises cloth which is coated on the plurality of surface areas with a fire fuel;
c. loosely rolling the coated fuel material strip into a spiraled cylindrical coil thereby defining a plurality of sections radially spaced within the spiraled cylindrical coil, creating a gap between each of the the plurality of sections;
d. providing the spiraled cylindrical coil with an exterior side wall, and a radius;
e. providing an at least one wick comprising: a secured wick end and an opposing free wick end;
f. placing the spiraled cylindrical coil in an upright position;
g. pressing and securedly fastening the secured wick end into the spiraled cylindrical coil within a center position of the spiraled cylindrical coil, and extending the opposing free wick end generally from the centrally located apex point over the radius of the spiraled cylindrical coil and generally vertically downward and substantially and conveniently down the exterior side wall of the spiraled cylindrical coil;
h. stacking combustible kindling material around and proximal to the spiraled cylindrical coil;
i. igniting the wick at the opposing free wick end using an igniting means, the wick igniting the fire fuel causing the fire fuel to ignite the coated fuel material strip within the spiraled cylindrical coil causing a kindling fire;
j. exposing the plurality of sections adjacent to the gap to the kindling fire;
k. transforming the fire fuel into a combustible gas within the gap, thereby augmenting combustion of the fire fuel increasing the temperature of the kindling fire;
l. igniting nearly simultaneously the plurality of sections of the spiraled cylindrical coil; and
m. igniting the combustible kindling material surrounding the spiraled cylindrical coil.

18. The method for starting the kindling fire of claim 17, wherein the fire fuel comprising one of: paraffin wax or beeswax.

19. The method for starting the kindling fire of claim 17, wherein the combustible kindling material comprising at least one of: combustible wood, coal, charcoal or other solid fuel material.

20. The method for starting the kindling fire of claim 17, wherein the cloth comprising: organic fibers.

21. The method for starting the kindling fire of claim 17, wherein the cloth comprising: paraffin coated cloth strips.

22. The method for starting the kindling fire of claim 17, wherein the at least one wick comprising at least one of: cotton string, roping, twine, cloth, hemp, other natural fiber or non-woven fibrous material.

23. The method for starting the kindling fire of claim 17, wherein the igniting means comprising at least one of: a match, igniter, lighter or other fire lighting implement.

* * * * *